US005832543A

United States Patent [19]

Bosserman

[11] Patent Number: 5,832,543

[45] Date of Patent: Nov. 10, 1998

[54] PORTABLE POCKET SPITTOON

[75] Inventor: Fredrick F. Bosserman, Madison, Tenn.

[73] Assignee: Bossmere Products, Inc., Madison, Tenn.

[21] Appl. No.: 694,590

[22] Filed: Aug. 9, 1996

[51] Int. Cl.[6] ..... A61J 19/00

[52] U.S. Cl. ..... 4/259; 4/267; 4/283; 215/337; 220/326

[58] Field of Search ..... 4/258, 259, 267, 4/271, 283; 220/326, 339; 215/337

[56] References Cited

U.S. PATENT DOCUMENTS

| | | | |
|---|---|---|---|
| D. 312,908 | 12/1990 | Muchmore . | |
| D. 313,098 | 12/1990 | Boyd . | |
| D. 343,937 | 2/1994 | Wooten et al. . | |
| 3,746,162 | 7/1973 | Bridges | 220/339 X |
| 3,811,563 | 5/1974 | Fox | 220/339 X |
| 4,162,547 | 7/1979 | Jenkins | 4/259 |
| 4,218,787 | 8/1980 | Puckett . | |
| 4,421,246 | 12/1983 | Schultz et al. | 220/339 X |
| 4,858,250 | 8/1989 | Lee . | |
| 4,885,809 | 12/1989 | Muchmore . | |
| 4,908,882 | 3/1990 | Williams et al. . | |
| 5,116,139 | 5/1992 | Young et al. | 383/49 |

FOREIGN PATENT DOCUMENTS

| | | | |
|---|---|---|---|
| 0287873 | 8/1931 | Italy | 4/267 |

*Primary Examiner*—Charles E. Phillips
*Attorney, Agent, or Firm*—Stein, Schifino & Van Der Wall

[57] ABSTRACT

A disposable portable pocket spittoon comprising a container having a top access opening. A means for selectively closing and opening the container is connected to the container. A fill funnel is inserted through the top open end and suspended within the container in order to direct spittle within the container. An absorbent material is retained within the container to immediately absorb a tobacco chewer's expectorate and which will not release the expectorate. This spittoon is intended to be used with only one hand and permit concealment of the container in a tobacco chewer's pocket with out spilling.

6 Claims, 2 Drawing Sheets

PORTABLE POCKET SPITTOON

BACKGROUND OF THE INVENTION

1. Field of the Invention

The present invention relates to spittoons for tobacco and snuff users. This invention more particularly pertains to disposable portable spittoons capable of being carried in a tobacco chewer's or snuff dipper's pocket.

2. Description of the Background Art

Presently, there exists various types of spittoons designed to contain spittle produced from tobacco chewing and snuff. Most commercially available spittoons are well known and consist merely of an open topped container placed on the floor of a room in the public view. This type of spittoon is often missed by a tobacco chewer's stream of tobacco juice. This expectorate often remains on the floor in the view of by-standers. Also, the tobacco juice expectorate that lands in a floor spittoon has to be washed out. This exposes someone other than the tobacco chewer to distasteful and unsanitary conditions.

While these spittoons worked well on the floor, it was quickly learned that a cover or lid may be used to conceal the expectorate from public view. A typical example of such a spittoon may be found in U.S. Pat. No. 863,445 issued to Ray on Aug. 13, 1907. This patent discloses a hinged lid operated by a foot pedal. Also, this device includes a funnel for directing expectorate into the spittoon.

The U.S. Pat. No. 4,858,250, issued to Lee, pertains to a disposable covered spittoon. This devise additionally discloses an absorption block with a receiving hole formed therethrough. The absorption block disclosed is of a high molecular hydrophilic polymer. The receiving hole through this block is lined with cilia in order to retain expectorate within the container. However, this devise does not contain a funnel for directing spittle within the spittoon and onto the absorption material or for retaining the absorption material within the container.

Also, U.S. Pat. No. 4,908,882, issued to Williams et al, discloses a covered spittoon with an inner funnel, as well as, an absorbing material such as a sponge which is treated with deodorant and disinfectant. However, this spittoon does not easily allow for concealment of the complete spittoon in a tobacco chewer's pocket. Moreover, this device is hard to manufacture in a compact and liquid-tight manner to be safely used in a tobacco chewer's pocket. Accordingly, it was realized that a means should be provided for easily and discretely containing and disposing of expectorate tobacco juice in a socially acceptable manner. Also, an absorption material having the properties necessary to absorb the expectorate and not release the expectorate in the manner a sponge would is needed. Thus, these prior spittoons do not effectively soak up and retain the expectorate from tobacco use.

In response to the realized inadequacies of earlier spittoons, it became clear that there is a need for a simple and inexpensive spittoon that may be used by a tobacco chewer or snuff user which may be discreetly kept in their shirt or pants pocket. This device must also provide for accurate control of spittle flow to ensure the spittle is directed effectively upon the absorption material such that no expectorate is later spilled from the spittoon. Inasmuch as the art consists of various types of spittoons, it can be appreciated that there is a continuing need for and interest in improvements to spittoons, and in this respect, the present invention addresses these needs and interests.

Therefore, the principal object of this invention is to provide an improvement which overcomes the aforementioned inadequacies of the prior art devices and provide an improvement which is a significant contribution to the advancement of the spittoon art.

Another objective of this invention is to provide a new and improved spittoon which has all the advantages and none of the disadvantages of the earlier spittoons.

Still another objective of the present invention is to provide an easily manufactured and marketed spittoon that is of durable and reliable construction.

Yet another objective is to provide a spittoon which is both portable and compact such that the spittoon may be stored in a tobacco chewer's pocket.

Still a further objective of the present invention is to provide a spittoon that easily sold in conjunction with tobacco products.

Yet a further objective of the present invention is to provide a portable spittoon which may be stacked on top of other spittoons as well as other tobacco products.

Even still a further objective of the present invention is to provide a portable spittoon economically available to the tobacco chewing public.

An additional objective of the present invention is to provide a spittoon which may be easily opened as well as raised up to the mouth with only one hand by a tobacco chewer or snuff user while chewing.

Another objective of the present invention is to provide absorbing material contained within the spittoon for retaining the expectorate within the spittoon and which will not subsequently release the expectorate.

Even yet another objective is to provide a container for storing expectorate from tobacco chewing which is not readily noticeable as a spittoon.

Still yet another objective is to provide a spittoon which is shaped like a typical pack of cigarettes.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. This invention satisfies the need for a portable and concealable spittoon that may be routinely carried with relative ease without spilling unexpectedly. For the purpose of summarizing this invention, this invention comprises a container having an open end, closed end, and an inner wall surface. A means for selectively closing and opening the container is attached to the edge of the open end of the container.

A fill funnel is inserted through the open end of the container such that spittle is directed within the container. The fill funnel is suspended within the container at the inner opening edge of the container. Also, in one particular embodiment, the fill funnel is obround and is formed having two parallel sides and circular ends so that the funnel conforms with the inside of a typical cigarette pack shaped container.

The absorbent material is received in the container and maintained beneath the fill funnel. Absorbent materials such as starch-grafted sodium polyacrylate will retain expectorate and not subsequently release it. In one particular embodiment, the absorbent material may be impregnated upon a paper insert.

Moreover, while the present invention is carried by the tobacco product user, the tobacco user's errant movements shift the absorbent material within the container. Therefore, alternative absorption surface areas are exposed during the course of a chew or a dip and the absorption material is then less likely to cake-up or clot. In the case of the present invention, errant movements of spittoon containing tobacco juices are actually desired.

An important feature of the present invention is that the complete spittoon is pocket sized such that the spittoon may be concealed in a tobacco chewer's pocket during the course of a chew.

Another important feature of the present invention is that the complete spittoon is compact enough to be raised up to the mouth of a tobacco chewer.

Another important feature of the present invention is that the spittoon contains a super absorbent material that immediately absorbs expectorate as it rolls down the container and lands upon the absorbent material. Moreover, this super absorbent material will not subsequently release the expectorate.

In one particular embodiment, the absorbent material is impregnated upon a paper insert. The paper insert is folded so that it is sized to be received by the container and so that multiple absorbent surfaces are provided to facilitate absorption. The paper insert is folded in the middle such that there are at least four potential surfaces for coming into contact with incoming expectorate. The paper insert fills substantially the entire container so that expectorate contacts the absorbing material immediately upon entering through the funnel and into the container. Thus, increased surface area for absorption is provided because the expectorate rolls down the complete length of the paper insert of any of the potential sides. Also, the absorbent material may be placed upon other forms, such as a sponge, to retain the material within the container. The absorbent material may even coat the inner wall surface of the container.

Another important feature is that the fill funnel also retains the absorbent material as well as the expectorate within the container during use by the tobacco chewer.

Another important feature of the present invention is to provide a means to open and close the spittoon so that the spittoon may be easily used and carried with one hand during the course of a chew. In one particular embodiment, the means for selectively opening and closing comprises a typical screw cap which may be screwed upon the container.

Alternatively, the cap may comprise a pivotal cap secured to the back of the container which may be actuated by a tab for snap-fitting the cap to the container. More specifically, the cap could comprise of a inner and outer surface where the outer surface has an outer retaining tab extending from the outer surface. The inner surface could have an inner retaining tab in a fashion that it cooperates with the outer retaining tab. Also, the retaining tabs could engage ridges located at the top opening access of the container such that the means for selectively opening and closing engages the container.

Therefore, it can be readily appreciated that the present invention precludes premature and unintentional leaking of expectorate caused by errant movements by the tobacco chewer which frequently occurs during the course of a day. However, these same errant movements increase the available absorbing surface area for incoming expectorate within the container.

The foregoing has outlined rather broadly, the more pertinent and important features of the present invention. The detailed description of the invention that follows is offered so that the present contribution to the art can be more fully appreciated. Additional features of the invention will be described hereinafter. It should be appreciated by those skilled in the art that the conception and the disclosed specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the invention, reference should be directed to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
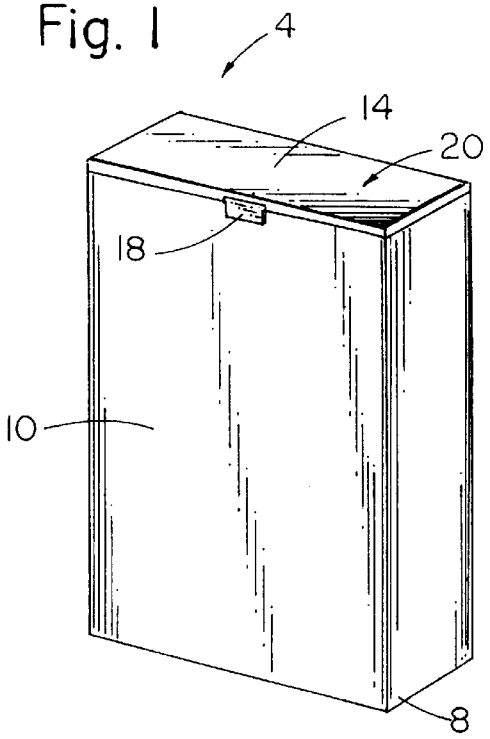
FIG. 1 is a perspective view of the portable pocket spittoon according to the preferred embodiment of the present invention.

With reference to the drawings, and in particular to FIG. 1, a new and improved portable pocket spittoon embodying the principles and concepts of the present invention and generally designated by the reference numeral 4 will be described. As shown in FIG. 1, the portable pocket spittoon 4 comprises a container 10, a cap 14, an obround funnel 30 and an absorbent paper insert 40. The container 10 and cap 14 has a general cigarette pack shape. Most preferably, the material constituting the pocket spittoon 4 comprises a material such as plastic which is commonly known in the industry.

Figure 4B:
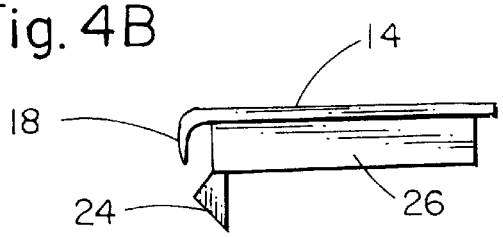
FIG. 4B is a side view of the cap of the portable pocket spittoon shown in FIG. 1 according to the preferred embodiment of the present invention.

As shown in FIG. 1, the cap 14 has an outer surface 20 and an outer retaining tab 18 extending from the outer surface. Also, as can be seen from FIG. 4A, the cap 14 has an inner surface 22 from which a perimeter flange 26 extends. The perimeter flange 26 has a pair of inner retaining tabs 24 that cooperate with the outer retaining tab 18. The cooperation between outer tab 18 and inner tabs 24 is illustrated in FIG. 4B.

Figure 4A:
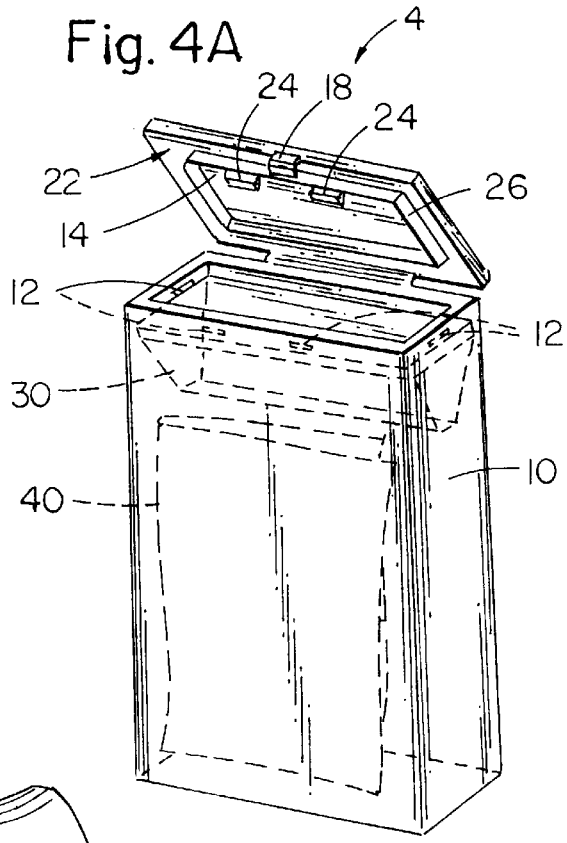
FIG. 4A is a perspective view of the pocket spittoon shown in FIG. 1 with the cap in the open position and illustrating the internal construction and various internal parts of the pocket spittoon.
Figure 5:
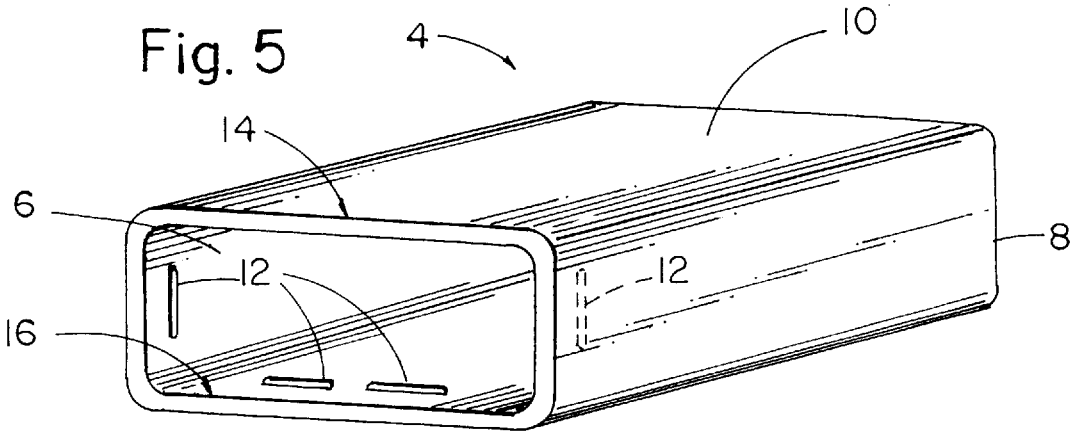
FIG. 5 is a view of the open end of the container of the pocket spittoon shown in FIG. 1 illustrating the engaging ridges according to the preferred embodiment.

As shown in FIG. 5, the container 10 comprises an open end 6 and closed end 8. The open end 6 has an inner opening edge 16 and an outer opening edge 14. The inner opening edge 16 has a plurality of engaging ridges 12 such that the inner retaining tabs 24 operatively engage the cap 14 to the container 10 to close the pocket spittoon 4. The cap 14 is pivotally connected to the open end 6 of the container 10 as shown in FIG. 4A.

Figure 2A:
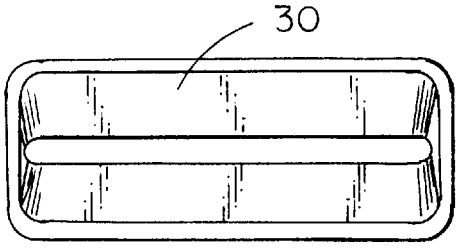
FIG. 2A is a top view of the obround fill funnel according to the preferred embodiment.
Figure 2B:
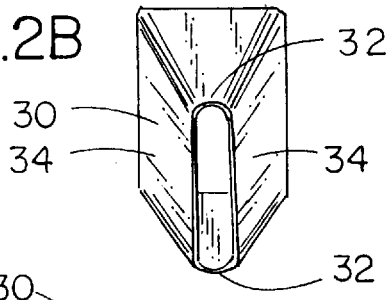
FIG. 2B is a side view of the obround fill funnel according to the preferred embodiment of the present invention.
Figure 2C:
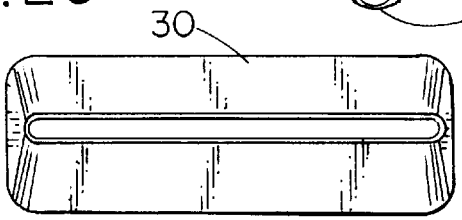
FIG. 2C is a bottom view of the obround fill funnel according to the preferred embodiment.

In referring to FIGS. 2A through 2C, the fill funnel 30 is generally obround in order to conform to the internal shape of the container 10. Simply, the sides 34 of the fill funnel 30 are parallel and these parallel sides 34 are joined at two circular ends 32. The funnel 30 is secured in the container 10 by at least one of the plurality of engaging ridges 12 such that the fill funnel 30 is forcibly retained within the container 10. FIG. 4A illustrates the fill funnel being retained in the container 10 by engaging ridges 12 at the circular ends 32.

Figure 3:
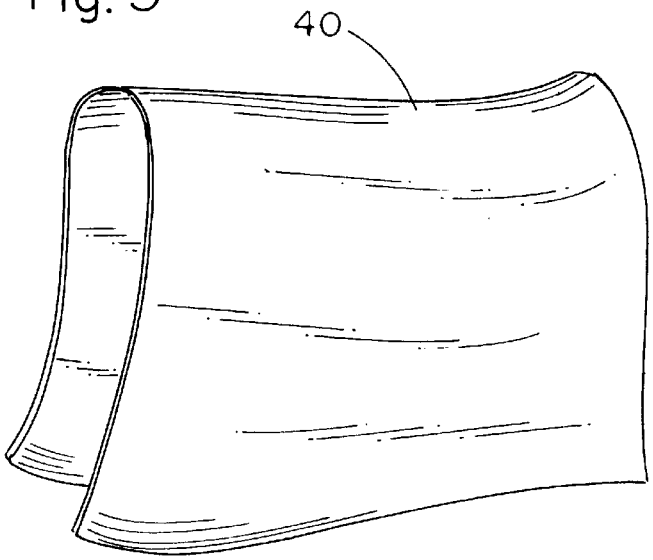
FIG. 3 is a perspective view of the absorbent paper insert according to the preferred embodiment of the present invention.

FIG. 3 illustrates the preferred embodiment of the absorbent paper insert 40. In this preferred embodiment, the paper insert 40 is substantially impregnated with starch-grafted sodium polyacrylate which is a super absorbent material. The absorbent paper insert 40 is folded such that it is sized to be received within the container 10 and such that it fills the entire container 10 from the closed end 8 up to the fill funnel 30 to facilitate absorption. The absorbent paper insert 40 is folded to create multiple surface areas to facilitate absorption as the incoming expectorate rolls down the surfaces.

In the preferred embodiment, the paper insert 40 is approximately four inches wide and two and a half inches in height. The paper insert 40 is folded in the middle to form two halves that are two inches by two and a half inches such that the paper insert 40 substantially fills the container 10, with inserted funnel 30, from top to bottom of the container 10.

Once the absorbent paper insert 40 is placed within the container 10, the fill funnel 30 is placed over the absorbent paper insert 40 which secures it within the container 10. Alternatively, and not shown, the super absorbent material may be placed in the container 10 on a sponge or other multiple surface form.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A portable pocket spittoon comprising:

a container having an open end and an inner wall surface, said open end having an inner opening edge;

means for selectively closing and opening said open end to said container, said means for selectively closing and opening connected to said container;

a fill funnel inserted through said open end, said fill funnel suspended within said container at said inner opening edge such that said fill funnel directs spittle within said container; and an absorbent material received within said container, said absorbent material being a starch-grafted sodium polyacrylate paper insert extending from a bottom of said container to immediately below said fill funnel, said fill funnel retaining said absorbent material within said container.

2. A portable pocket spittoon as claimed in claim 1, wherein said means for selectively closing and opening is a cap having an inner surface and outer surface, said outer surface having an outer retaining tab extending from said outer surface, said inner surface having an inner retaining tab in a fashion to cooperate with said outer retaining tab.

3. A portable pocket spittoon as claimed in claim 1, wherein the means for selectively closing and opening is a cap having an inner surface and an outer surface, said outer surface having an outer retaining tab extending from said outer surface, said inner surface having an inner retaining tab, and wherein said inner opening edge of said container includes at least one engaging ridge such that said inner retaining tab engages said ridge.

4. A portable pocket spittoon as claimed in claim 1, wherein said fill funnel is obround having two parallel sides.

5. A portable pocket spittoon as claimed in claim 1, wherein said paper insert is approximately four inches by two and a half inches such that said paper insert is generally sized to be received within said container and substantially fills said container from said closed end up to said fill funnel when folded.

6. A portable pocket spittoon comprising:

a cap having an inner surface and outer surface, said outer surface having an outer retaining tab extending from said outer surface, said inner surface having a perimeter flange extending from said inner surface, said perimeter flange having a pair of inner retaining tabs;

a container having open and closed ends, said open end having an inner opening edge and an outer opening edge, said inner opening edge having a plurality of engaging ridges such that in a closed position said pair of inner retaining tabs engage said engaging ridges and said outer retaining tab is located externally of said container, said cap being pivotally coupled to said open end of said container;

an obround fill funnel with two parallel sides and two circular ends inserted through said open end, said fill funnel suspended within said container at said inner opening edge such that said obround fill funnel is secured within said container; and an absorbent paper insert sized to be received within said container such that said absorbent paper insert substantially fills said container from said closed end up to said obround fill funnel when folded, said obround fill funnel retains said absorbent paper insert within said container, said paper insert treated substantially with starch-grafted sodium polyacrylate.

* * * * *